US007401447B2

(12) United States Patent
Marshall et al.

(10) Patent No.: US 7,401,447 B2
(45) Date of Patent: Jul. 22, 2008

(54) CONTAINER CLOSER

(75) Inventors: Steven Marshall, Fort Mill, SC (US); Christian Matthew Yungbluth, Matthews, NC (US)

(73) Assignee: Ultrablend, LLC, Charlotte, NC (US)

( * ) Notice: Subject to any disclaimer, the term of this patent is extended or adjusted under 35 U.S.C. 154(b) by 0 days.

(21) Appl. No.: 11/383,090

(22) Filed: May 12, 2006

(65) Prior Publication Data

US 2007/0261370 A1 Nov. 15, 2007

(51) Int. Cl.
*B65B 7/28* (2006.01)

(52) U.S. Cl. ..... 53/329; 53/324; 53/328; 100/902

(58) Field of Classification Search ..... 53/305, 53/310, 311, 312, 319, 324, 327, 329, 328; 100/902
See application file for complete search history.

(56) References Cited

U.S. PATENT DOCUMENTS

| | | | | | |
|---|---|---|---|---|---|
| 538,290 | A | * | 4/1895 | Stahl | 53/319 |
| 558,760 | A | * | 4/1896 | Becker | 53/329 |
| 594,781 | A | * | 11/1897 | Dolley et al. | 53/319 |
| 602,837 | A | * | 4/1898 | Dollfus | 53/319 |
| 1,125,041 | A | * | 1/1915 | Beadle | 53/310 |
| 1,196,159 | A | * | 8/1916 | Schmitt | 53/329 |
| 1,407,448 | A | * | 2/1922 | Townsend | 53/329 |
| 1,931,435 | A | * | 10/1933 | Davis et al. | 53/319 |
| 1,989,039 | A | * | 1/1935 | Geyer | 53/310 |
| 2,256,574 | A | * | 9/1941 | Price | 53/310 |
| 2,665,832 | A | * | 1/1954 | Bagby | 53/310 |
| 2,704,629 | A | * | 3/1955 | Andre et al. | 53/319 |
| 2,712,893 | A | * | 7/1955 | Charland | 53/310 |
| 2,768,491 | A | * | 10/1956 | Gatheridge | 53/310 |
| 2,849,847 | A | * | 9/1958 | Anderson | 53/310 |
| 2,914,901 | A | * | 12/1959 | Kinsley, Jr. et al. | 53/310 |
| 3,715,865 | A | * | 2/1973 | Davis | 53/319 |
| 3,855,759 | A | * | 12/1974 | Pohlenz | 53/310 |
| 4,068,449 | A | * | 1/1978 | Harper | 53/319 |
| 4,290,354 | A | * | 9/1981 | Stevens | 100/902 |
| D274,624 | S | * | 7/1984 | DiFede | D15/122 |
| 4,569,281 | A | * | 2/1986 | Woods | 100/902 |
| 5,058,498 | A | * | 10/1991 | Chen | 100/902 |
| 5,188,024 | A | * | 2/1993 | Li | 100/902 |
| 5,890,349 | A | * | 4/1999 | Heisler et al. | 53/329 |
| 6,137,408 | A | * | 10/2000 | Okada | 340/556 |

OTHER PUBLICATIONS

Red Devil Equipment Co.; Lid Press; [online]; No date [retrieved on Aug. 7, 2006]; Retrieved from the Internet: URL: http:/www.red-devilequipment.com/lid_press.html.

Fluid Management, Inc. A Unit of IDEX Corporation; Can Lid Sealer; [online]; No date [retrieved on Aug. 7, 2006]; Retrieved from the Internet: URL: http://www.fluidman.com/brochures/cansealer.pdf.

* cited by examiner

*Primary Examiner*—Louis K Huynh
(74) *Attorney, Agent, or Firm*—Adams Intellectual Property Law, P.A.

(57) ABSTRACT

A closer for pressing a lid onto a container includes a presser foot mounted for reciprocating movement into and out of force applying engagement with the lid; an actuator moveable between retracted and extended positions; and a force multiplying assembly disposed in operative relationship intermediate the presser foot and the actuator for multiplying an input force from the actuator to a predetermined maximum lid pressing force at the extended position.

16 Claims, 16 Drawing Sheets

Fig. 13A
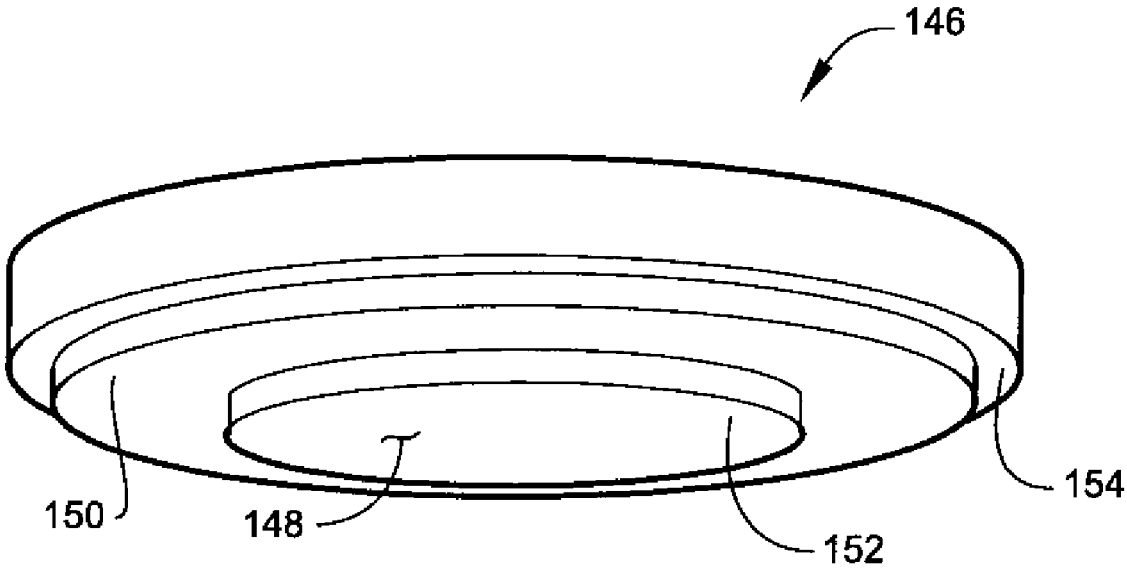
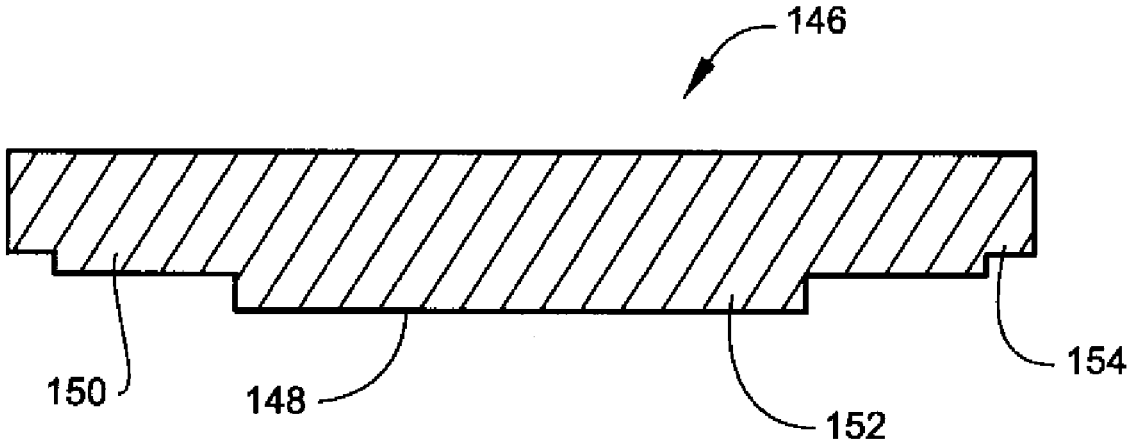
Fig. 13B

CONTAINER CLOSER

BACKGROUND OF THE INVENTION

This invention relates generally to closing and sealing of fluid containers.

Various kinds of fluids are stored in containers that must be tightly sealed. For example, paint is often sold in plastic or metal cans with press-fit lids.

Paint is often tinted by mixing appropriate amounts of colorants into a can of base paint. The paint can is capped with a press-fit lid and agitated, which thoroughly mixes the colorant throughout the base paint and produces paint of the desired color. The machines used to mix the paint subject the can to high forces, and require that the can be securely sealed and undamaged in order to avoid leakage or failure.

The most common method for sealing a paint can involves hammering the lid down with a rubber mallet or similar tool. This is inconsistent and can cause paint spillage. The prior art has attempted to replace the mallet with hand-operated press-type sealing machines or "closers" that multiply manual force to the required level. However, these machines are dependent on operator skill to achieve consistent sealing, and are also capable of crushing a paint can if used too vigorously.

BRIEF SUMMARY OF THE INVENTION

Accordingly, it is an object of the invention to provide a container closer that provides a consistently high closing force independent of operator technique.

It is another object of the invention to provide a container closer that limits the force applied to a can lid.

It is another object of the invention to provide a container closer which is relatively insensitive to the alignment of the container.

These and other objects are met by the present invention, which according to one embodiment provides a container closer for pressing a lid onto a container, including a presser foot mounted for reciprocating movement into and out of force applying engagement with the lid; an actuator moveable between retracted and extended positions; and a force multiplying assembly disposed in operative relationship intermediate the presser foot and the actuator for multiplying an input force from the actuator to a predetermined maximum lid pressing force at the extended position.

According to another embodiment of the invention, an elastic member forms a part of the interconnection between the actuator and the presser foot, and is arranged such that the lid pressing force is proportional to the displacement of the actuator; and the actuator has a limited throw such that the elastic member maintains a margin of elastic deflection at the extended position of the actuator.

According to another embodiment of the invention, the elastic member is a coil spring.

According to another embodiment of the invention, the container closer further includes a reciprocating shaft connected to the presser foot and adapted to be driven by the actuator; and an elastic member interconnecting the shaft and the force multiplying assembly such that the lid pressing force is proportional to the displacement of the elastic member.

According to another embodiment of the invention, a distance representing the overall length of the presser foot and the shaft is adjustable.

According to another embodiment of the invention, the force multiplying assembly includes a stationary mounting block; a lever arm pivotally connected to the mounting block, the lever arm having a first end connected to the actuator and a second end carrying a cam; and a cam follower disposed between the cam and the elastic member.

According to another embodiment of the invention, the closer further includes a top plate disposed at an upper end of the shaft; and a retraction roller carried by the second end of the lever arm and positioned to contact the top plate on upward motion of the second end of lever arm.

According to another embodiment of the invention, the closer includes a pushrod connecting the actuator and the first end of the lever arm.

According to another embodiment of the invention, the actuator is a manually-operable handle.

According to another embodiment of the invention, the closer further includes a housing having: a base plate; a pair of spaced-apart side walls extending upwards from the base plate; and a top plate extending between upper ends of the side walls, the top plate carrying the presser foot, actuator and force multiplying assembly. The housing is adapted to receive a container underneath the presser foot.

According to another embodiment of the invention, a container support is disposed between the side walls and moveable between: a first position in which the container support is clear of the presser foot to allow a can of a first size on the base plate under the presser foot; and a second position in which the container support is disposed under the presser foot so as to support a can of a second size under the presser foot.

According to another embodiment of the invention, the container support is mounted for pivoting movement between the first and second positions.

According to another embodiment of the invention, at least one alignment stop is disposed on the container support so as to align a can in a centered position underneath the presser foot.

According to another embodiment of the invention, at least one alignment stop is disposed on the base plate so as to align a can in a centered position underneath the presser foot.

According to another embodiment of the invention, the presser foot is sized to engage the lid while maintaining a clearance between the presser foot and a can rim surrounding the lid.

According to another embodiment of the invention, the presser foot has a convex curved working face.

According to another embodiment of the invention, the presser foot has a stepped working face with an outer portion sized to contact the lid of a first size container, and an inner, downward-protruding portion sized to contact the lid of a second size container smaller than the first size container.

According to another embodiment of the invention, the presser foot includes an outer ring sized to contact the lid of a first size container, and a coplanar inner ring sized to contact the lid of a second size container smaller than the first size container.

According to another embodiment of the invention, the actuator is a powered actuator, and means are provided for limiting the displacement imparted to the force-multiplying assembly by the actuator.

According to another embodiment of the invention, the closer further includes means for preventing operation of the actuator in response to the presence of any portion of a person's body underneath the presser foot.

According to another embodiment of the invention, the closer further includes means for operating the actuator in response to the presence of a container underneath the presser foot.

According to another embodiment of the invention, in a closer of the type for sealing a cylindrical can which has a raised peripheral can rim disposed at its upper end, and a press-fit lid having a flat center section and an upwardly-extending lid rim, the lid rim sitting below a plane of the can rim in a fully sealed condition, wherein the closer includes an actuator which moves a presser foot into and out of force applying engagement with the lid, the improvement includes: the presser foot having a working face which is sized to engage the lid rim while maintaining a clearance between the presser foot and the can rim.

BRIEF DESCRIPTION OF THE DRAWINGS

The subject matter that is regarded as the invention may be best understood by reference to the following description taken in conjunction with the accompanying drawing figures in which:

FIG. 13A is a perspective view of an alternative presser foot;

FIG. 13B is a cross-sectional view of the presser foot of FIG. 13A;

DETAILED DESCRIPTION OF THE INVENTION

Figure 1:
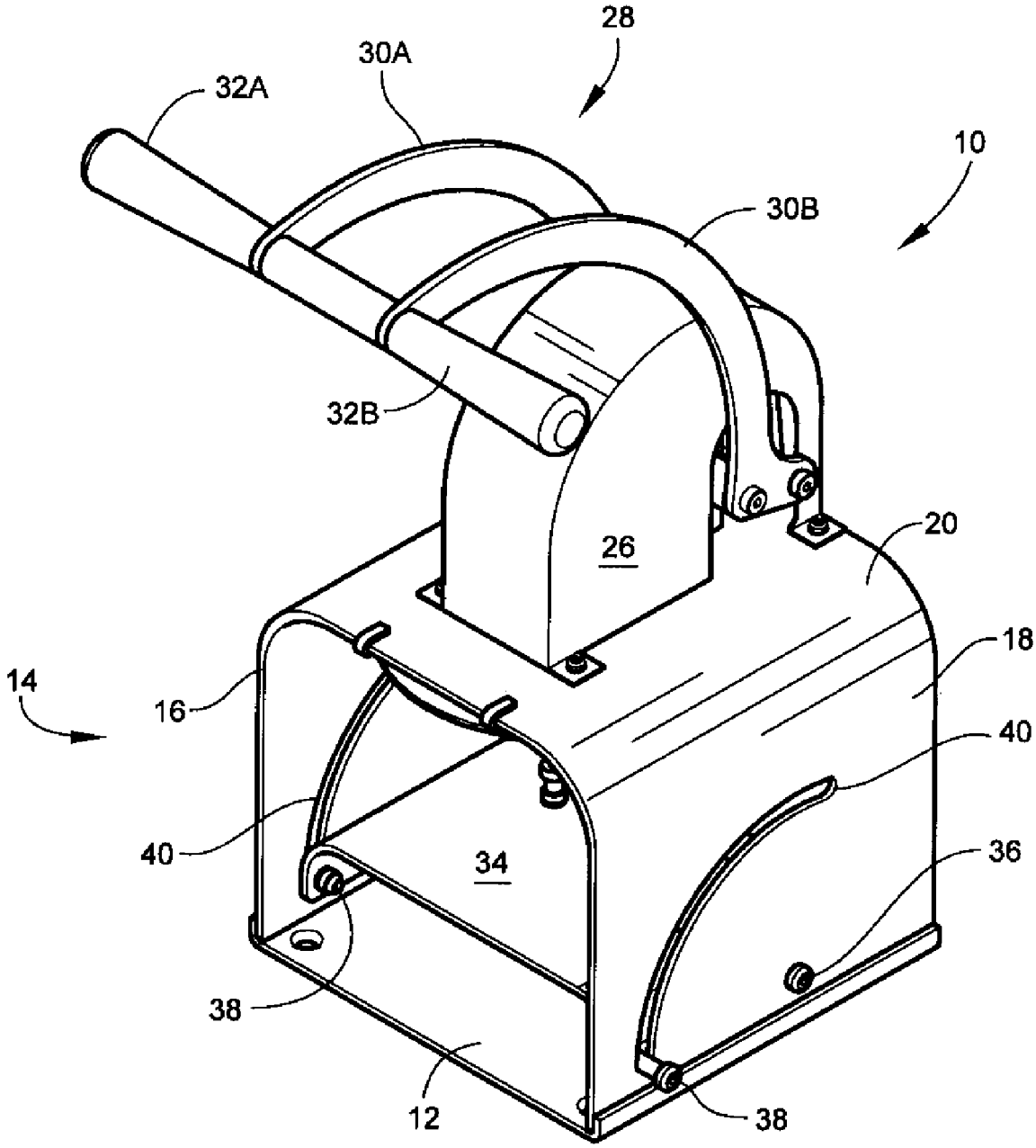
FIG. 1 is a perspective view of a container closer constructed according to the present invention.

Referring to the drawings wherein identical reference numerals denote the same elements throughout the various views, FIG. 1 shows an exemplary container closer, simply referred to as a "closer", and denoted 10. The closer 10 is especially adapted to press lids onto standardized paint cans, but it may be used with any type of container having a press-fit lid. The closer 10 includes a base plate 12 and a housing 14 with spaced-apart side walls 16 and 18 and a top wall 20. The housing 14 carries a presser assembly 22 (see FIG. 2) which is moved up and down by a force multiplying assembly 24 that is enclosed by a cover 26. An actuator 28 is provided to operate the closer 10 and is moveable between retracted and extended positions. In this example the actuator 28 is a handle having a pair of curved, spaced-apart arms 30A and 30B, and hand grips 32A and 32B.

The housing 14 is adapted to receive and hold a paint can and align it under the presser assembly 22. A flat container support 34 is carried inside the housing 14, and is mounted by way of hinge pins 36 at its aft end, and bearing pins 38 at its forward end, which ride in arcuate slots 40 formed in the side walls 16 and 18 of the housing 14. When the container support 34 is in the raised position, shown in FIG. 2, a relatively large can such as a standard one-gallon paint can may be placed under the presser assembly 22. When the container support 34 is in a lowered position, shown in FIGS. 1 and 3, a smaller container such as a standard one-quart paint can may be placed under the presser assembly 22.

The container support 34 includes a pair of protruding alignment stops 42 (see FIG. 7) that are positioned to align a standard one-quart can "Q" in a centered position below the presser assembly 22. The base plate 12 includes a second pair of protruding alignment stops 44 that are positioned to align a standard one-gallon can "C" in a center position below the presser assembly 22 (see FIG. 6).

Figure 2:
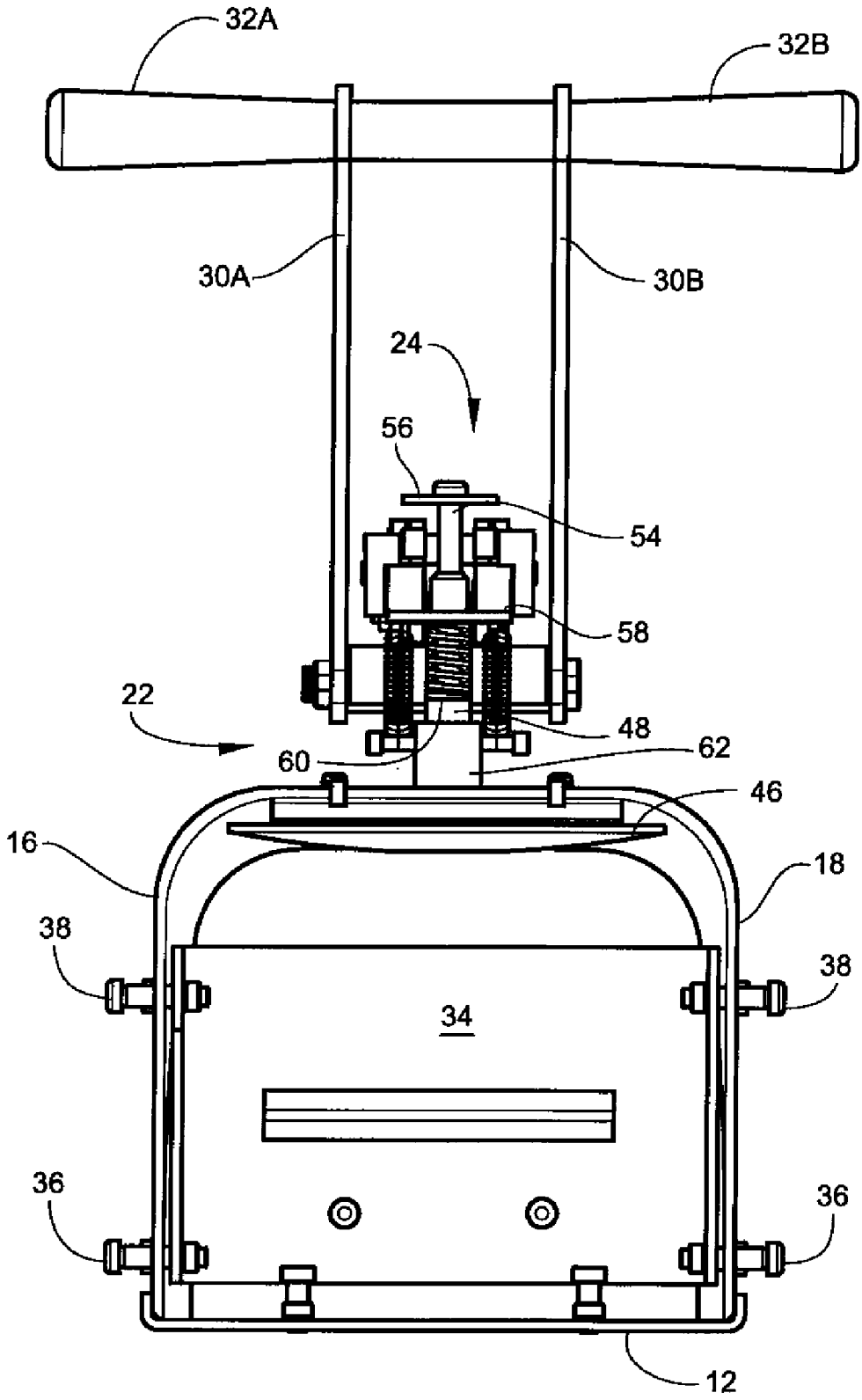
FIG. 2 is a front view of the closer of FIG. 1, with a container support thereof in a raised position.
Figure 3:
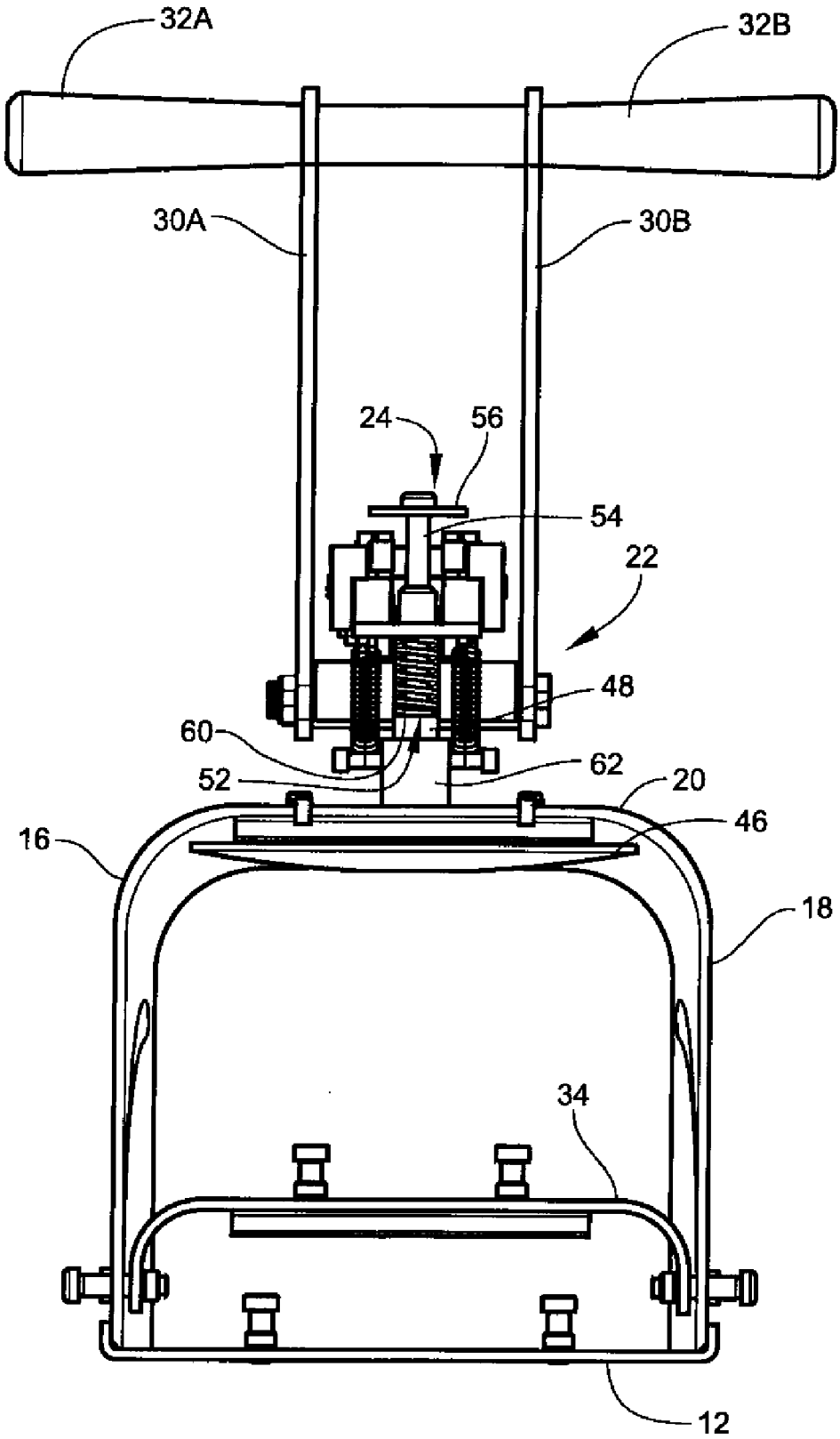
FIG. 3 is another front view of the closer of FIG. 1, with a container support thereof in a lowered position.

Referring to FIGS. 2 and 3, the presser assembly 22 includes a presser foot 46 connected to the lower end of a main shaft 48. The main shaft 48 has a lower portion 50 which defines a shoulder 52 and an upper, reduced-diameter portion 54. A top plate 56 is disposed at the upper end of the main shaft 48. A cam follower 58 is mounted for sliding movement on the upper portion 54 of the main shaft 48, and an elastic member 60 is disposed between the shoulder 52 and the cam follower 58. The entire presser assembly 22 is mounted within a sleeve 62 and is moveable between a raised position and a lowered position, relative to the housing 14.

The elastic member 60 may be any structure which is capable of interconnecting the presser foot 46 and the actuator 28 (the connection may be direct or indirect) and which exhibits recoverable elastic deflection when compressed, with a predictable force-displacement relationship. In the illustrated example, the elastic member 60 is a metallic, compression-type coil spring. The elastic member 60 may be placed in any location within the mechanical interconnection between the actuator 28 and the presser foot 46.

Figure 4:
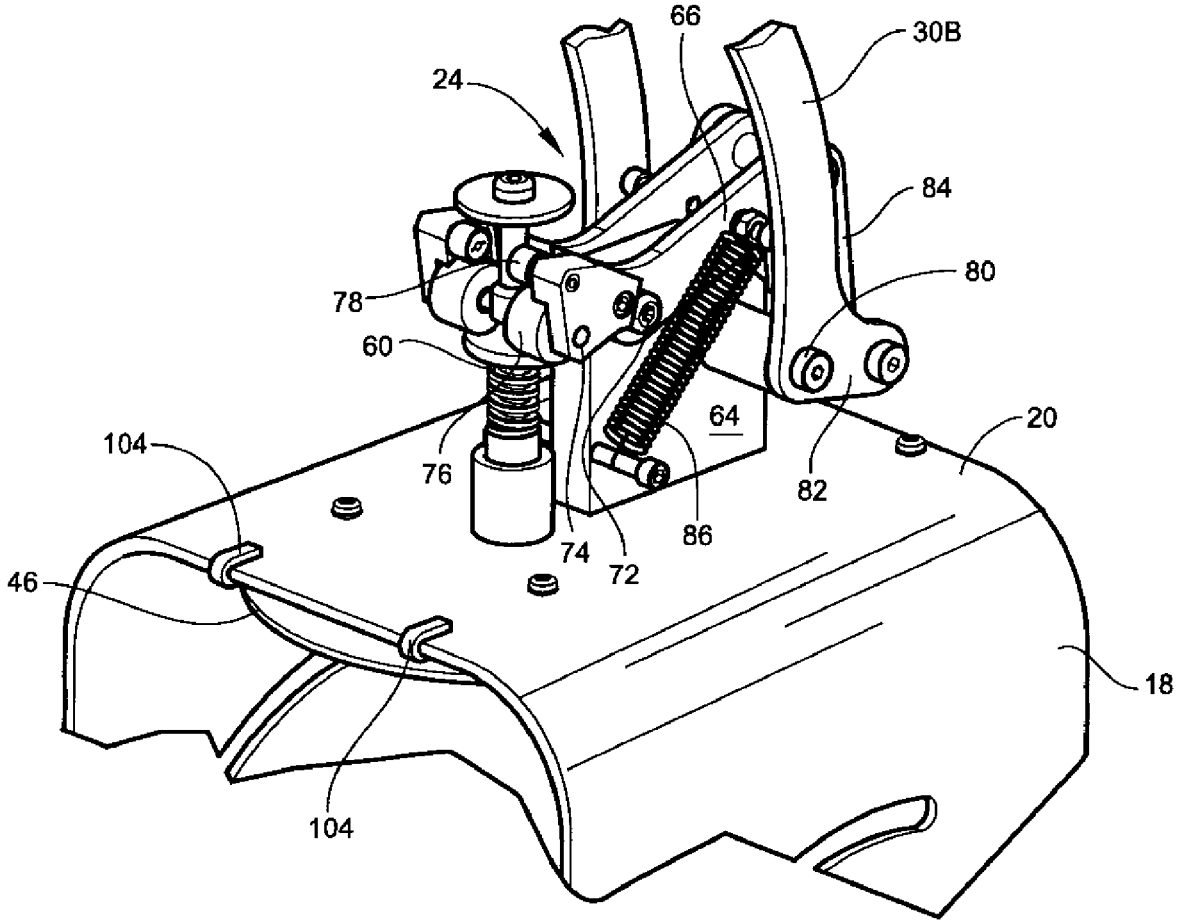
FIG. 4 is a front perspective view of a portion of the closer of FIG. 1, with a cover removed to show the internal mechanism thereof.
Figure 5:
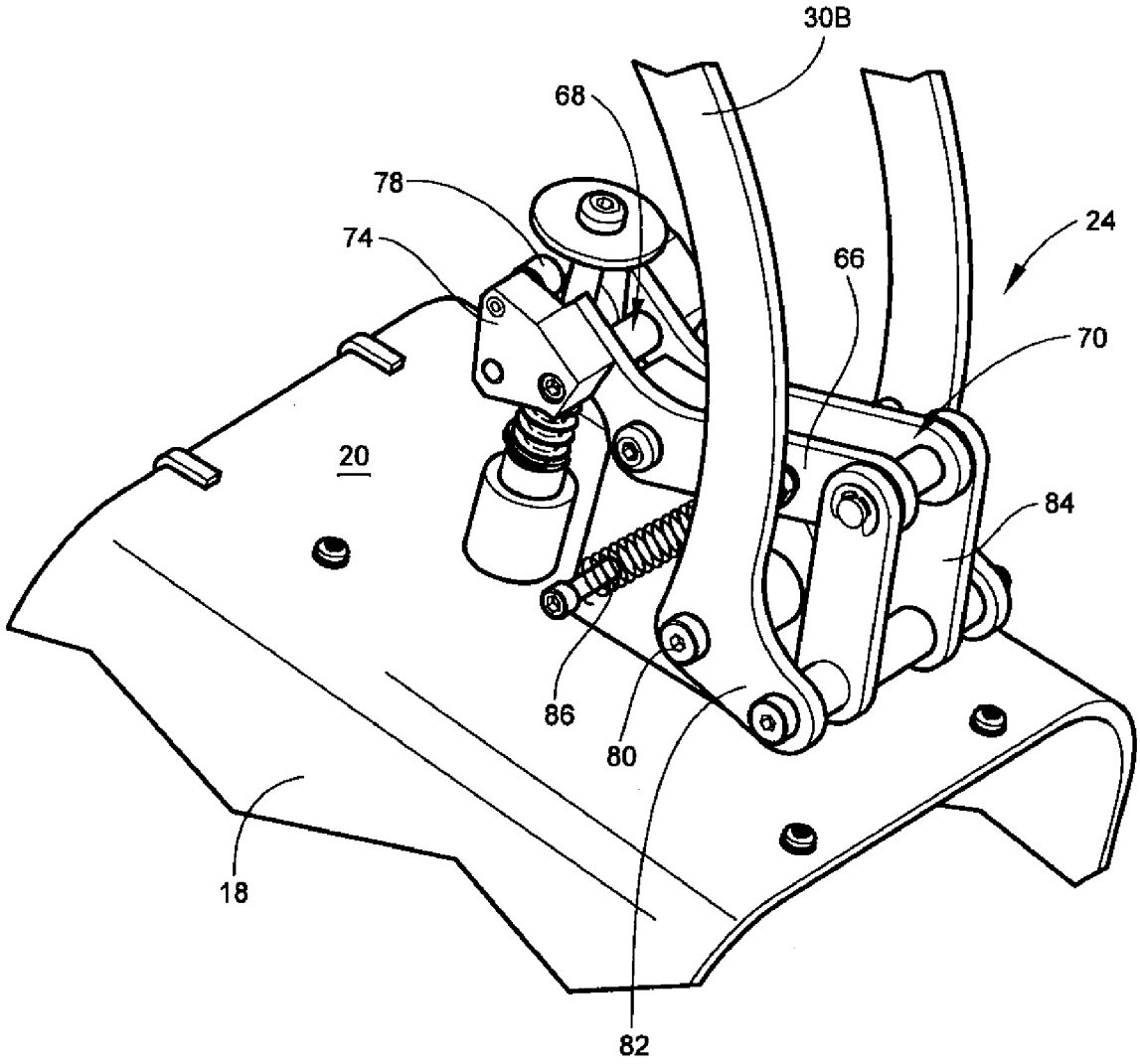
FIG. 5 is a rear perspective view of the mechanism shown in FIG. 4.

FIGS. 4 and 5 illustrate the force multiplying assembly 24 in more detail. A stationary mounting block 64 is mounted to the top wall 20 of the housing 14. It is noted that the moveable components of the force multiplying assembly 24 are arranged in symmetrical pairs on opposite sides of the mounting block 64. However, for purposes of clarity in explanation, only one set of moveable components will be described.

A generally horizontal lever arm 66 with forward and aft ends 68 and 70 is connected to the mounting block 64 at a lever pivot 72 which is disposed closer to its forward end 68. A cam block 74 disposed at the forward end 68 of the lever arm 66 carries a rotatable, generally cylindrical cam 76, and a retraction roller 78 positioned above the cam 76. The cam 76 is positioned by the lever arm 66 so that its axis of rotation is generally aligned with the vertical axis of the main shaft 48. Accordingly, downward motion of the forward end 68 of the lever arm 66 causes the cam 76 to bear against the cam follower 58, and upwards motion of the lever arm 66 causes the retraction roller 78 to bear against the top plate 56.

The inner end of the actuator arm 30 is connected to the mounting block 64 by an actuator pivot 80. The actuator arm 30 includes a short arm 82 which protrudes aft from the actuator pivot 80. A generally upright pushrod 84 interconnects the short arm 82 and the aft end 70 of the lever arm 66. A return spring 86 interconnects the lever arm 66 and the mounting block 64, and biases the lever arm 66 towards the retracted position.

The actuator 28, pushrods 84, and lever arm 66 are arranged to provide multiplication of an input force applied by the actuator 28 to a desired output force on the presser assembly 22. In this example, there is a two-stage compound leverage, with a total force multiplication ratio of about 20:1 (and an inverse displacement ratio). However, the location of pivot points, etc., the number of stages of multiplication, or the type of force-multiplying assembly could be modified as required to suit a particular application.

Figure 10:
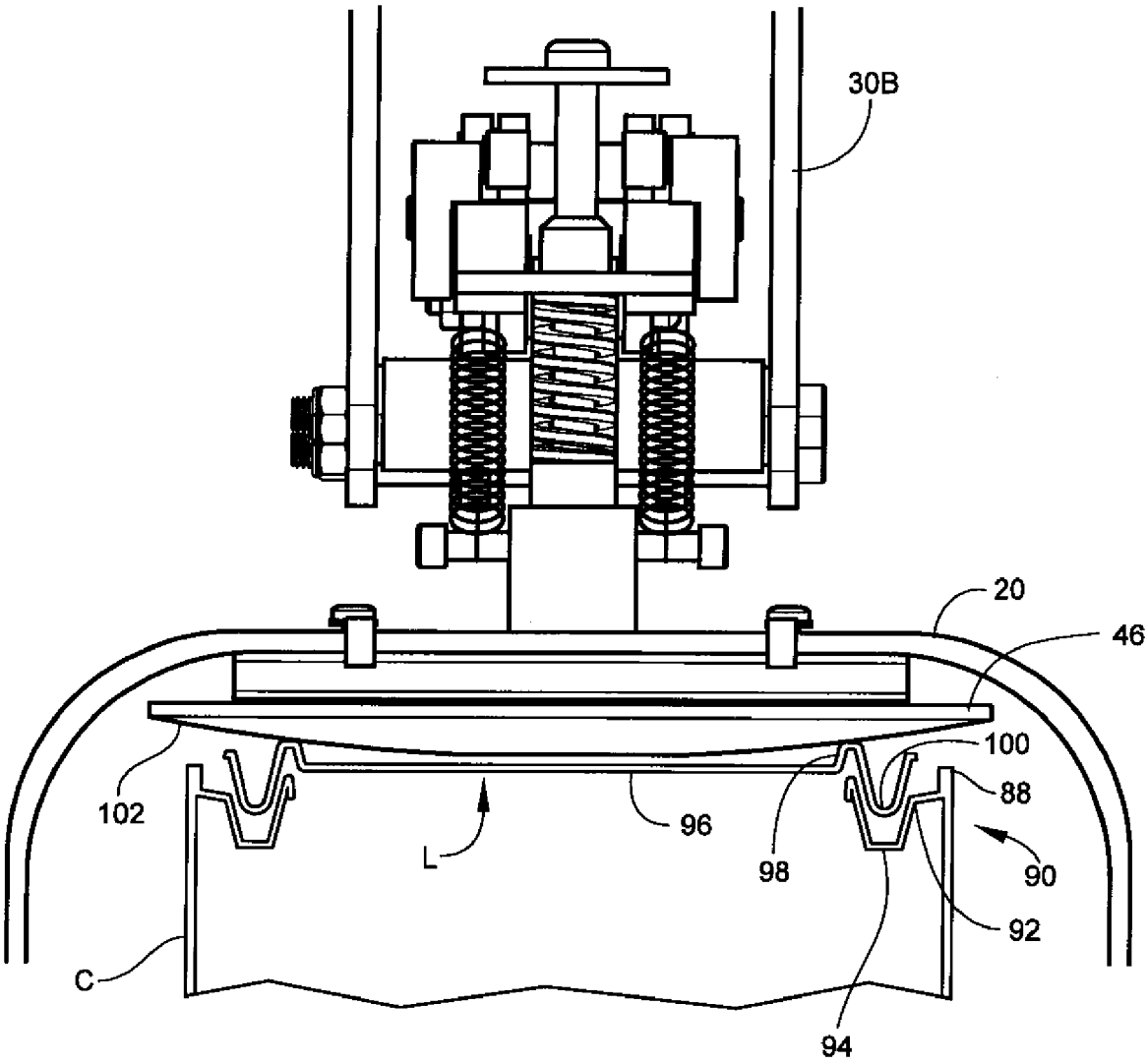
FIG. 10 is a front view of a portion of the closer shown in FIG. 1, with its cover removed, with a presser foot in a raised position above a container.
Figure 11:
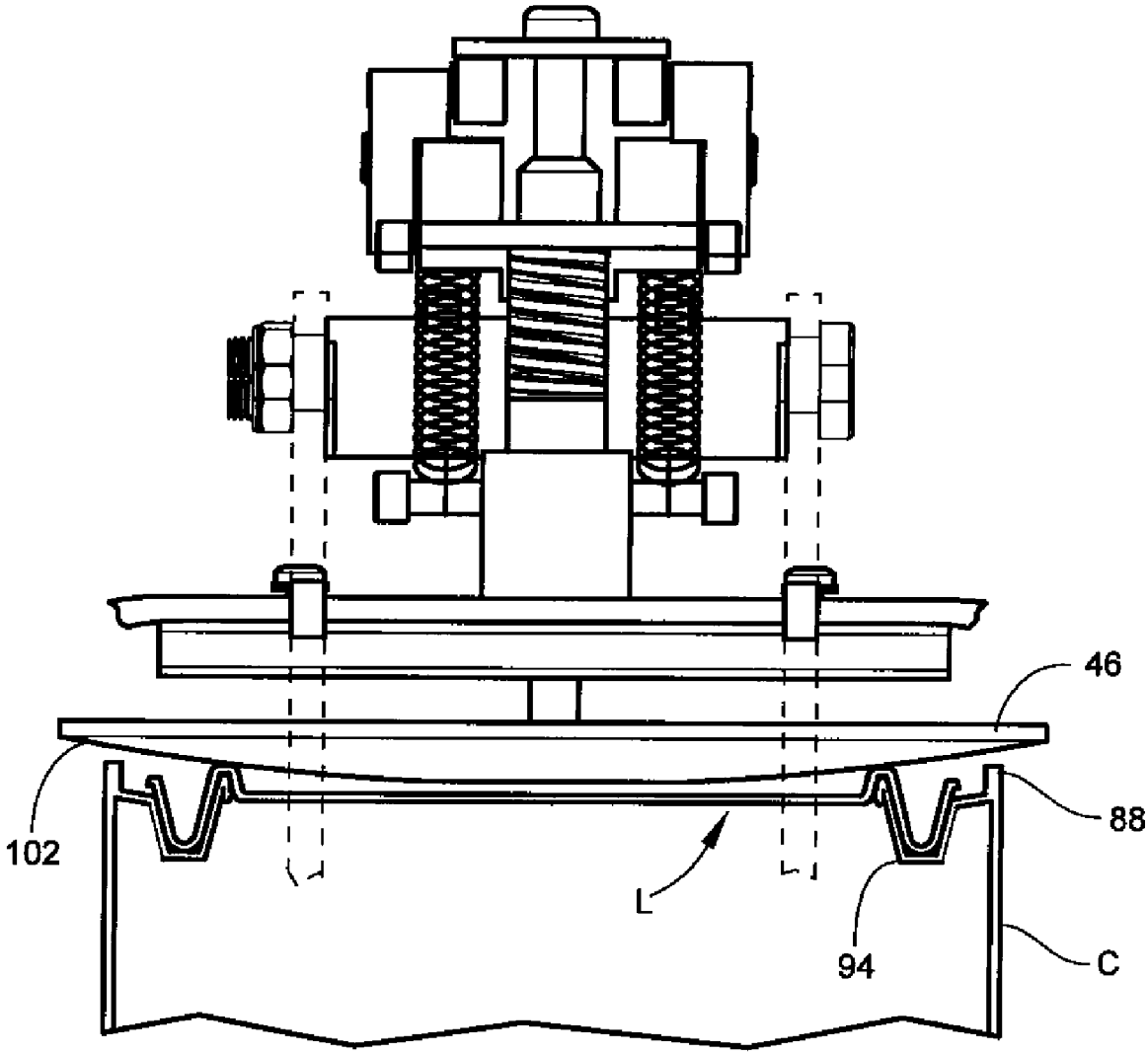
FIG. 11 is another view of the closer shown in FIG. 10, with a presser foot forcing a lid onto the container.
Figure 12:
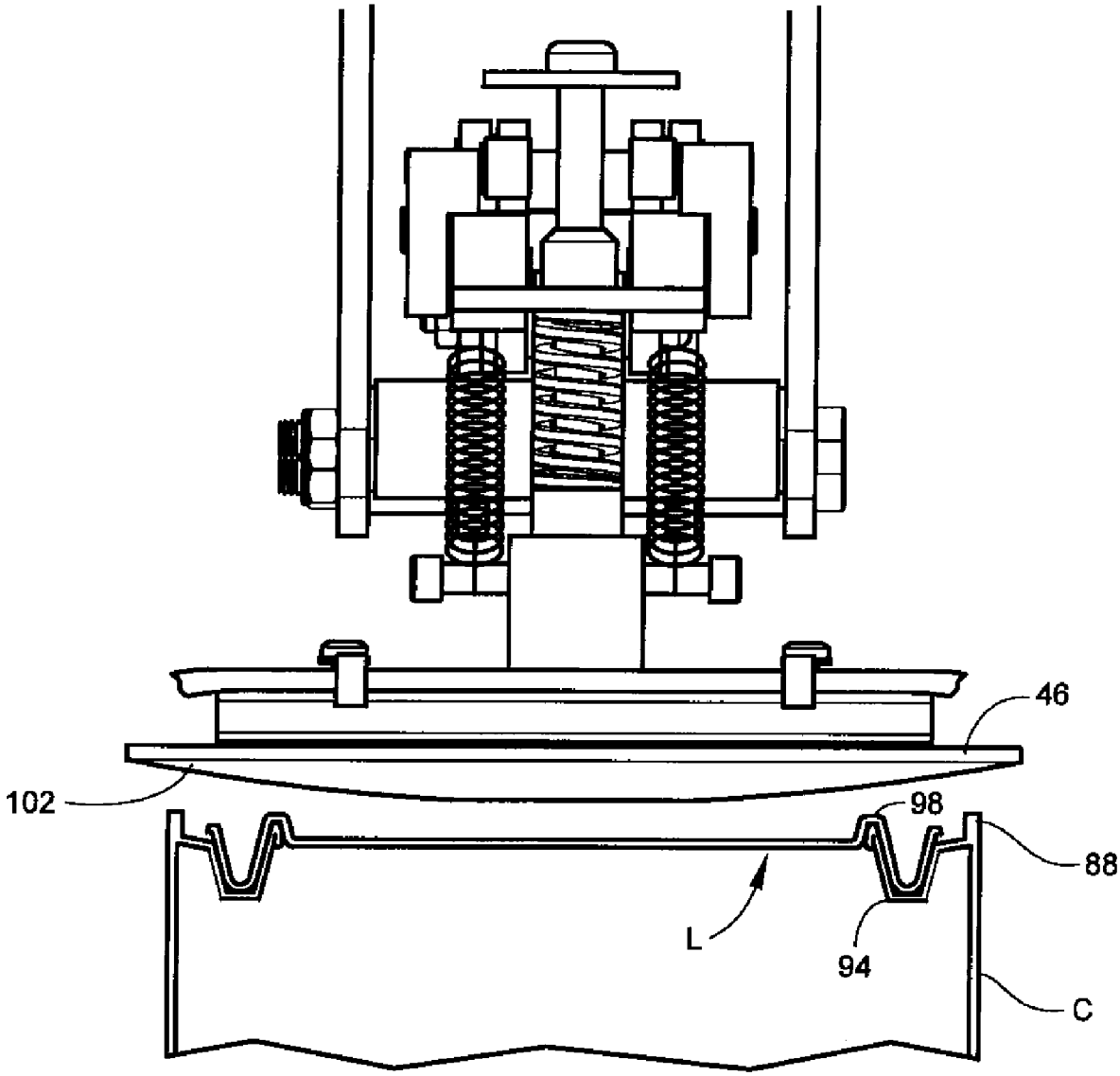
FIG. 12 is another view of the closer shown in FIG. 10, with a presser foot retracted after having pressed a lid onto a container.

Referring now to FIGS. 10-12, a typical can "C" and lid "L", and the presser foot 46, are shown in more detail. While paint cans vary in size, shape, and construction, the can C shown in partial cross-section in FIG. 10 is generally representative of the most common type of paint can. The can C is cylindrical, with a peripheral can rim 88 at its upper end 90. A flange 92 is disposed at the can's upper end 90 and forms a concave peripheral groove 94. The lid L has a flat center section 96, an upwardly-extending lid rim 98, and a downwardly-extending peripheral bead 100. The bead 100 is sized and shaped to securely engage the groove 94 when the lid L is fully seated, forming a liquid-tight seal.

It should be noted that, in the fully seated position (see FIG. 12), the lid rim 98 sits below the plane of the can rim 88. Therefore, in order to fully seat the lid L, it is preferred that the presser foot 46 not contact the can rim 88 during the closing process. At the same time, it is desirable to use a single presser foot 46 for various sizes of cans. A substantial load, for example at least about 100 Kg (220 lbs.) is required to fully seat the lid L, but the maximum load and the displacement must also be limited to avoid crushing of the can C. It is desirable to apply the closing force to the lid L through the lid rim 98 and not the thin center section 96.

As shown in FIG. 10, the presser foot 46 has a convex-downward working face 102, with an approximately spherical curvature. The radius of curvature is chosen such that the working face 102 will contact the lid rim 98 of various sizes of cans but will not contact the can rim 88. The curved shape helps ensure contact with the lid rim 98 even if the can C is not perfectly centered under the presser foot 46.

FIGS. 13A and 13B illustrate an alternative presser foot 146. Its working face 148 is stepped and has an outer portion 150 and a downward-protruding inner portion 152. The outer portion 150 is sized to contact the lid rim 98 of a one-gallon can C, while the inner portion 152 is sized to contact the lid rim of a one-quart can (not shown). A notch 154 is formed around the outer periphery of the outer portion 150 so as to avoid contact with the can rim 88.

Figure 14A:
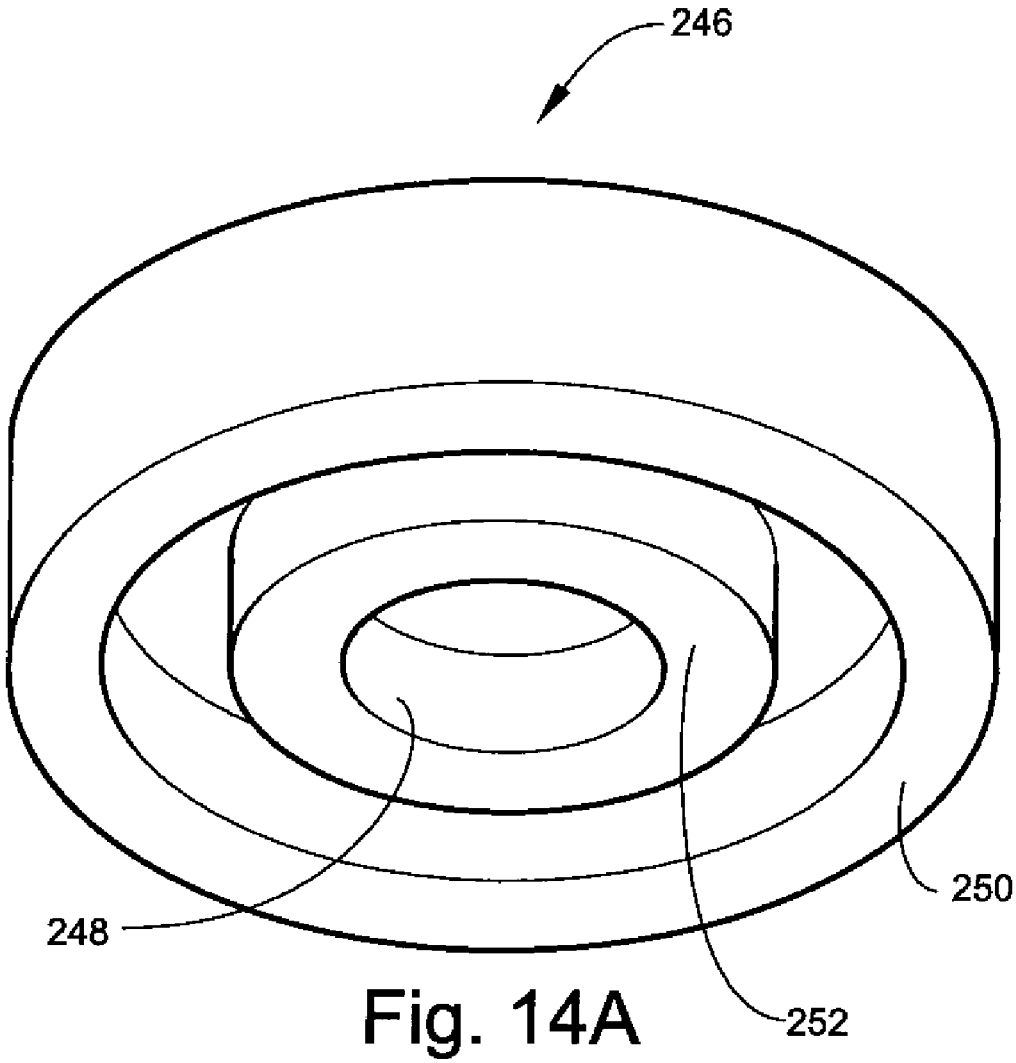
FIG. 14A is a perspective view of another alternative presser foot.
Figure 14B:
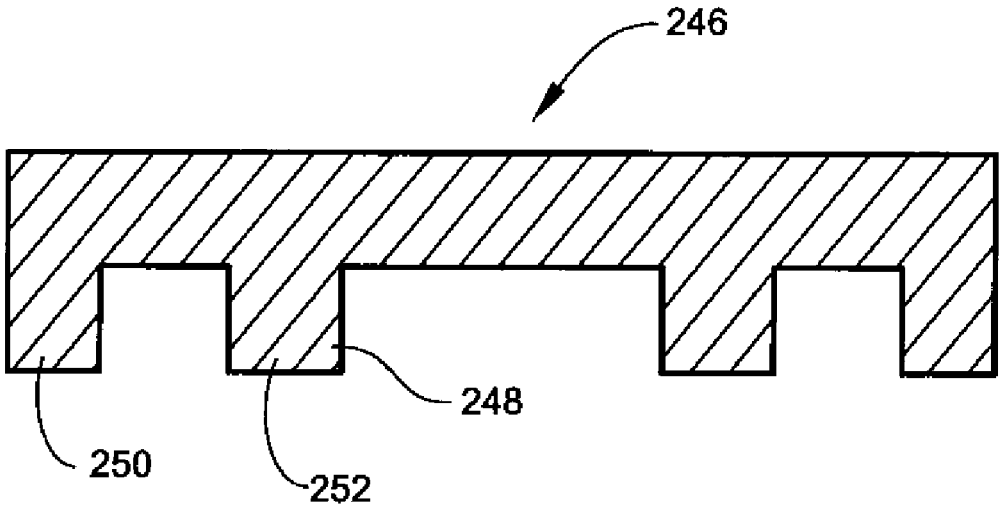
FIG. 14B is a cross-sectional view of the presser foot of FIG. 14A

FIGS. 14A and 14B illustrates another alternative presser foot 246. Its working face 248 defines an outer ring 250 and a coplanar inner ring 252. The outer ring 250 is sized to contact the lid rim 98 of a one-gallon can C, while the inner ring 252 is sized to contact the lid rim of a one-quart can (not shown). The outer diameter of the outer ring 250 is limited so as to avoid contact with the can rim 88.

Figure 6:
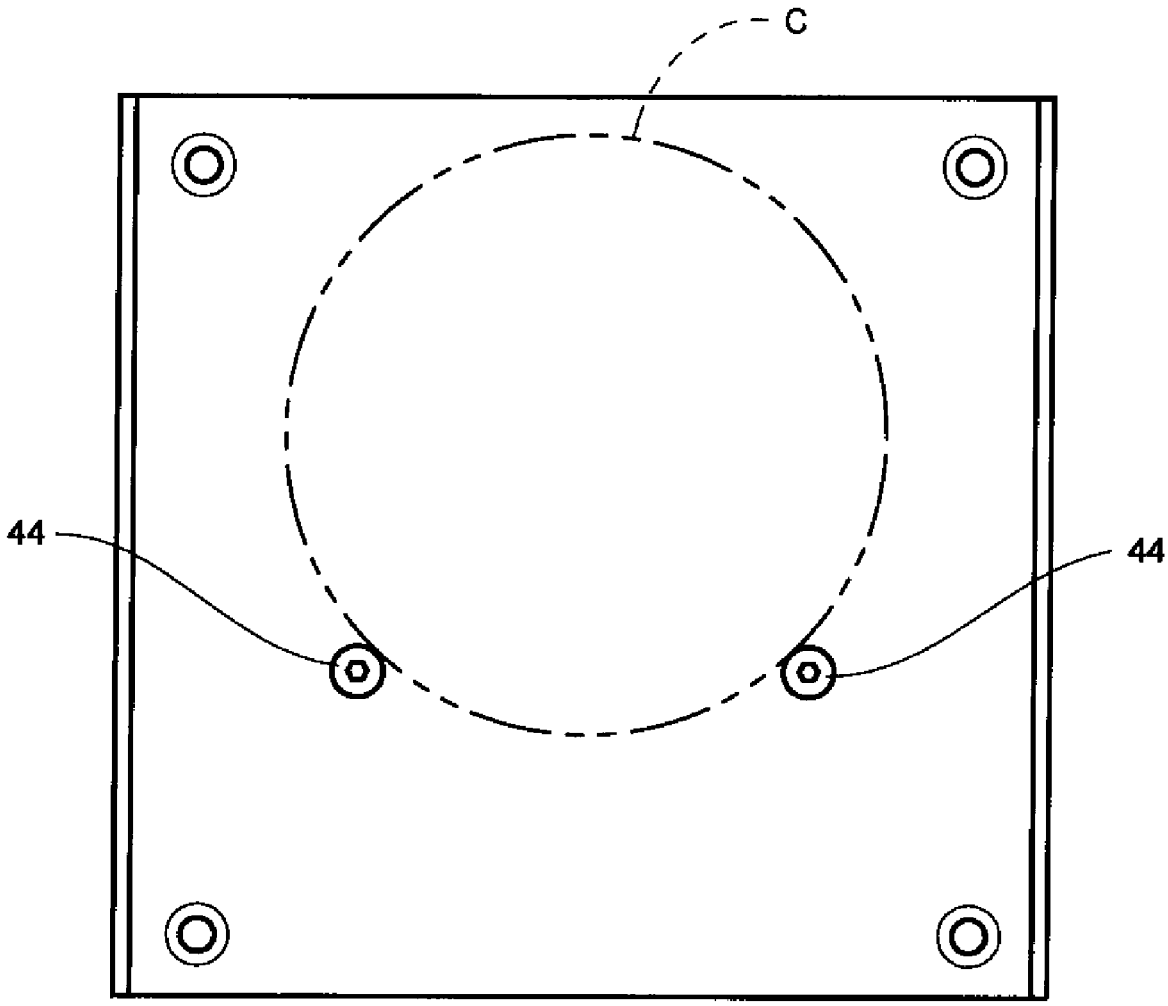
FIG. 6 is a top view of the base plate of the closer of FIG. 1.
Figure 7:
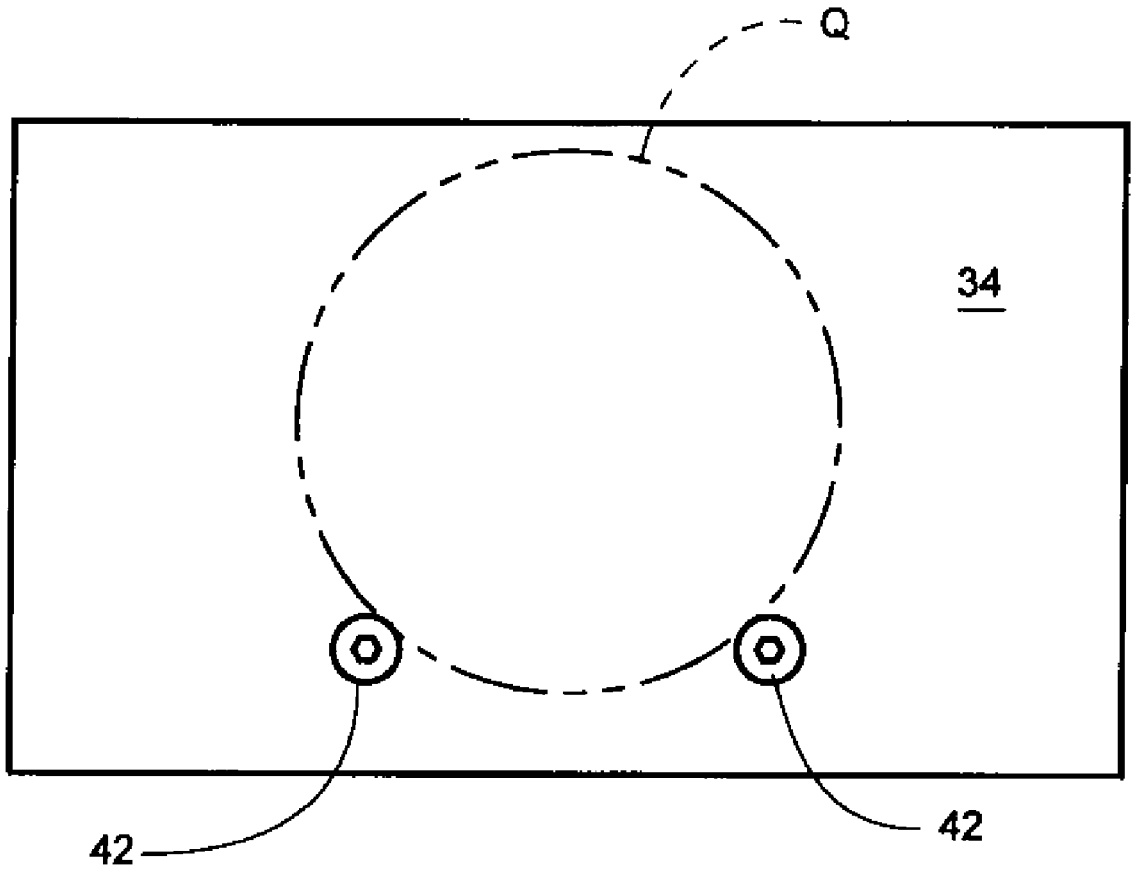
FIG. 7 is a top view of a container support in a lowered position.

The operation of the closer 10 will now be explained in detail with reference to FIGS. 10-12. First, the container support 34 is placed in the correct raised or lowered position for the size of can C to be closed. A can C is then placed either on the container support 34 or the base plate 12 against the alignment stops 42 or 44, as shown in FIGS. 7 and 6, respectively. This ensures the can C is centered under the presser foot 46. The lid "L" is placed on the can C with the bead 100 aligned with the groove 94 (this may be done before or after inserting the can C in the closer 10). The actuator 28 is then pulled downward, forcing the pushrod 84 up and pivoting the forward end of the lever arm 66 and the attached cam 76 downward. The cam 76 contacts the cam follower 58 and displaces the main shaft 48 and attached presser foot 46 downwards until the attached presser foot 46 contacts the lid L. Further downward motion of the cam 76 causes the elastic member 60 to compress as the bead 100 of the lid L is forced into the groove 94 of the can C.

Figure 8:
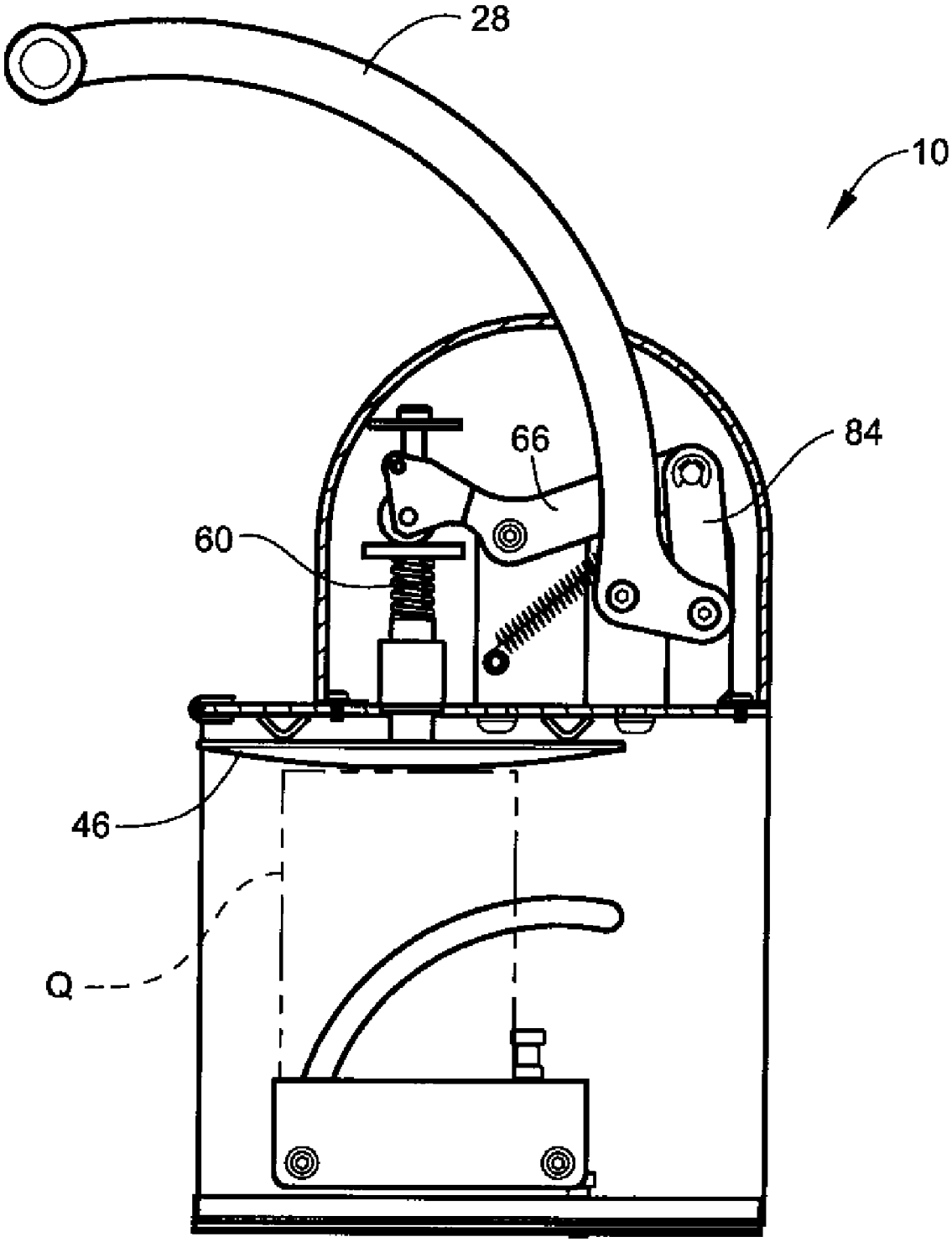
FIG. 8 is a side cross-sectional view of the closer of FIG. 1, with an operating handle in a raised position.
Figure 9:
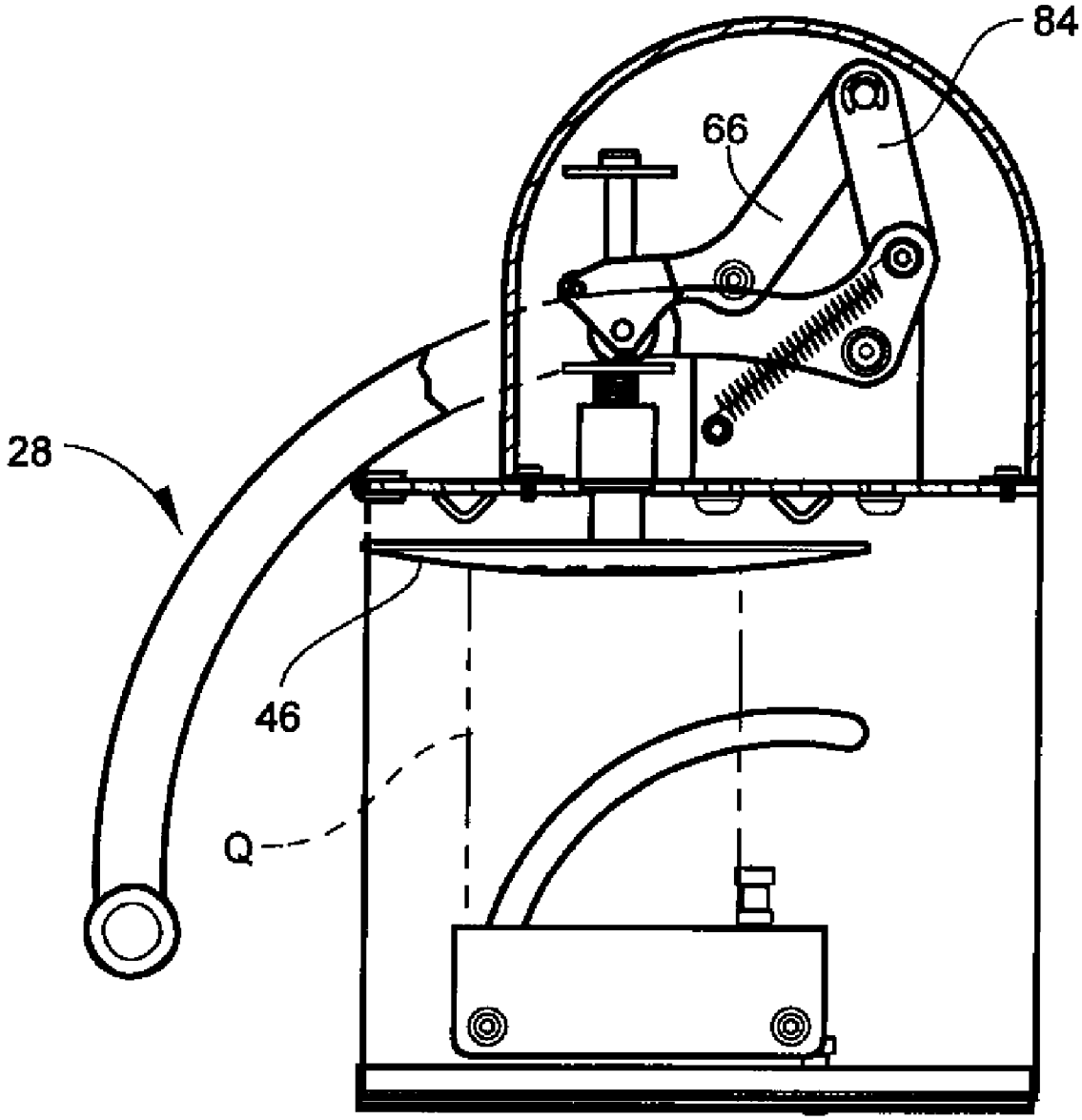
FIG. 9 is a side cross-sectional view of the closer of FIG. 1, with an operating handle in a lowered position.

The actuator 28 is stopped at the end of its throw by contact with the front edge of the housing 14, as best seen in FIG. 9. A bumper 104 may be provided on the housing 14 to prevent noise and damage. The fully sealed lid L is shown in FIG. 11. Once the seal is completed, the actuator 28 is released and returns to its upper position under the bias of the return springs 86 (see FIGS. 8 and 12), retracting the lever arm 66 with it. As it moves upward, the forward end of the lever arm 66 moves upward, causing the retraction roller 78 to bear against the top plate 56 and pull the entire presser assembly 22 clear of the can C. The can C may then be removed.

The effective spring rate of the elastic member 60 is chosen in conjunction with the throw (i.e. input displacement) of the actuator 28 and the dimensions of the housing 14, considering the height of the can C, so that a margin of elastic deflection is always maintained. In other words, in normal operation the closer 10 never experiences a "solid" mechanical interconnection between the actuator 28 and the presser foot 46 in the "closing" direction. Therefore, during the closing operation described above, the maximum force applied to the lid L and can C is independent of the input force. For example, if an input force in excess of the minimum required is applied, it will simply cause the entire mechanism to accelerate until the actuator 28 contacts the housing 14. The result is a lid-closing cycle with consistently high but not excessive force, with no specific operator technique required. In contrast, prior art closers which simply multiply an input force can be used to apply excessive force to the can C.

As an illustrative example, the elastic member 60 may be assumed to have an effective spring rate "K" over its operating range (typically expressed in Kg/cm or lbs./in.) The actual spring rate K will be chosen to accommodate the specific application, depending on the force requirements of the container to be closed. A movement of the actuator 28 through an effective throw designated "T", that is, a displacement after the elastic member begins to compress, with an effective leverage ratio of "R", will compress the elastic member 60 a distance equal to T/R. This will result in a maximum force on the can C equal to K*(T/R). The amount of this force that the lid L actually "sees" is dependent on the flexibility of the can C. Because of the compound leverage ratio R, the input force required to complete this motion is well within the physical ability of most all potential operators of the closer 10.

Figure 15:
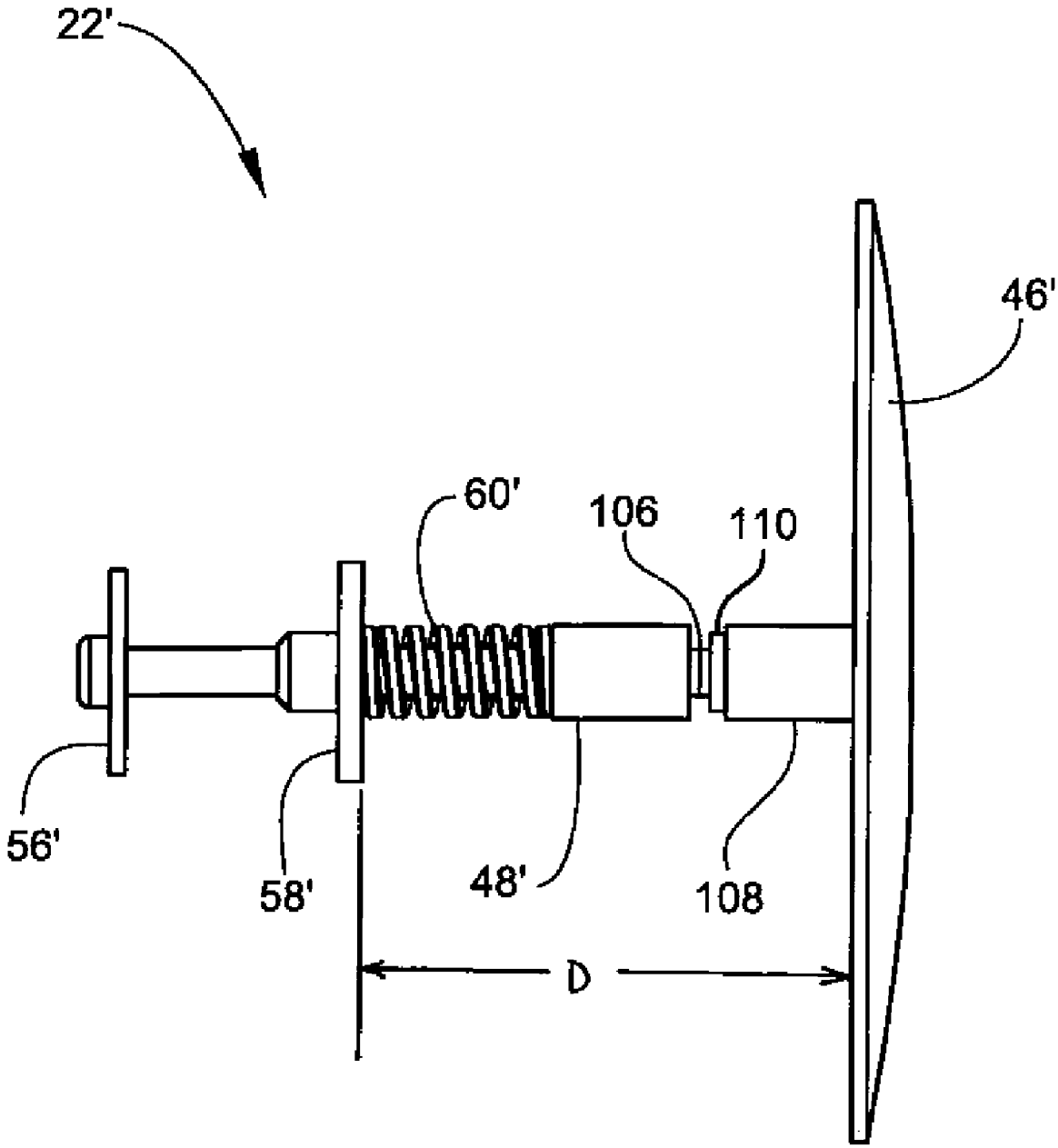
FIG. 15 is a side view of a presser assembly including an adjustment mechanism.

The maximum force applied to the can C will vary depending on the height of the can C, which may vary from manufacturer to manufacturer or among different production runs. To accommodate this variation, the closer 10 may incorporate means for adjusting the maximum force applied to the can C. For example, FIG. 15 illustrates an alternative presser assembly 22' similar in construction to the presser assembly 22 described above and having a main shaft 48, cam follower 58', top plate 56', elastic member 60', and presser foot 46'. A threaded adjustment shaft 106 protrudes downward from the main shaft 48'. The presser foot 106 has a stub shaft 108 with complementary female threads. This allows the total distance "D" from the neutral position of the cam follower 58' to the presser foot 46' to be varied. If a relatively taller can C is used with a fixed throw endpoint of the actuator 28, this will result in more compression of the elastic member 60 and higher maximum force on the can C, so the distance "D" would be shortened to compensate. With the same actuator throw endpoint, a relatively shorter can C would result in less compression of the elastic member 60 and lower force, so the distance "D" would be increased to compensate. The adjustment may be locked with a jam nut 110 or other suitable locking mechanism.

Figure 16:
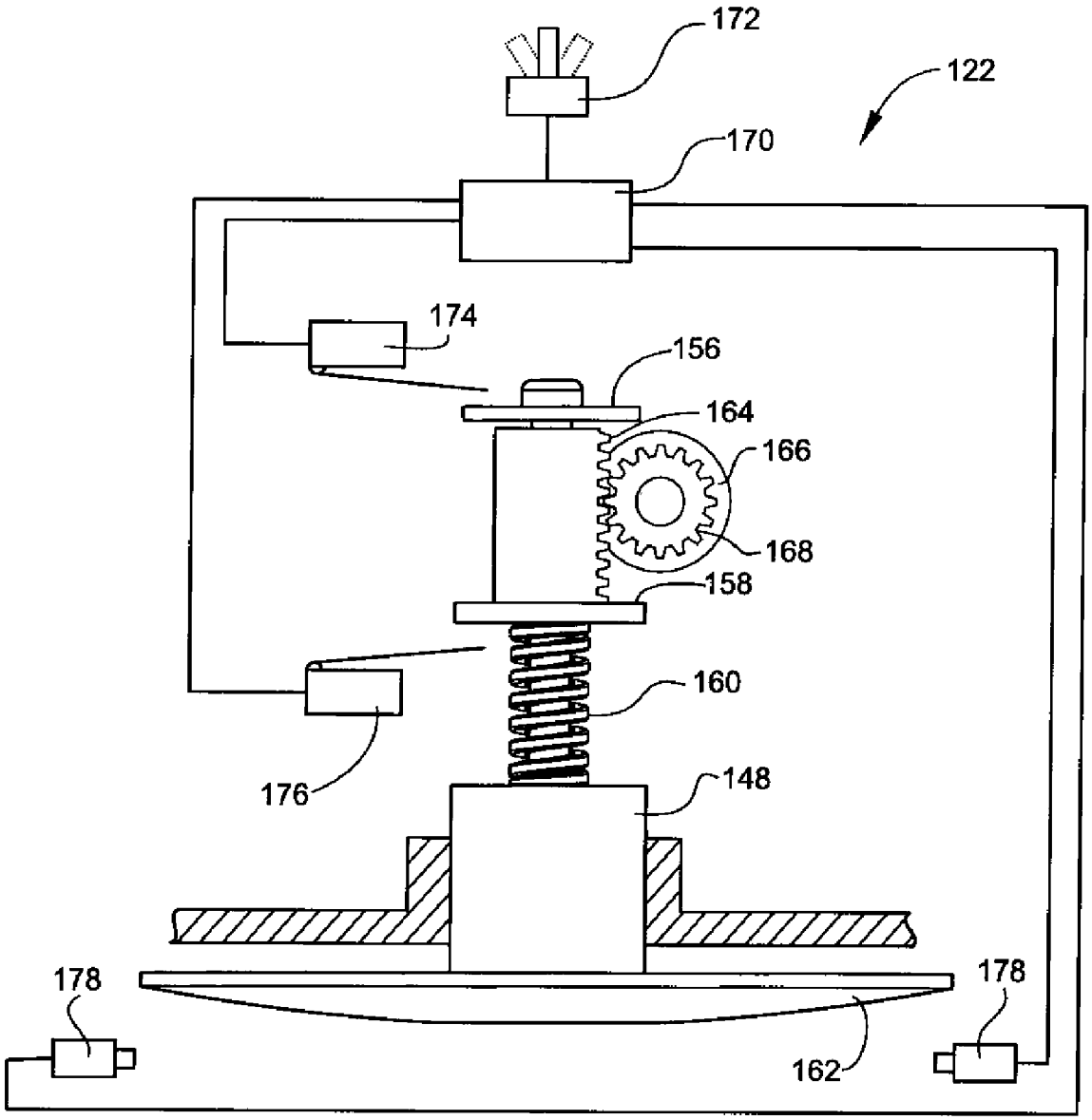
FIG. 16 is a side view of an alternative presser assembly including a powered actuator.

The invention has been described above with respect to manual operation. However the closer 10 may also be adapted powered operation. For example, FIG. 16 illustrates an alternative presser assembly 122 having a main shaft 148, cam follower 158, top plate 156, elastic member 160, and presser foot 162. The cam follower 158 includes a vertical rack gear 164. An electric motor 166 carries a pinion gear 168 which is engaged with the rack gear 164 to drive the cam follower 158 up or down as required.

A suitable power supply and controls are provided for the electric motor 166. These are shown schematically in FIG. 16 and include a power supply 170, a reversing switch 172, upper and lower limit switches 174 and 176, and optionally light beam sensors 178. The lower limit switch 176 or other suitable displacement sensor is configured to limit the compression of the elastic member 60 substantially as described above for the manually-operated closer 10. The cycling of the motor 166 may be controlled by the switch 172, in which case the light beam sensors 178 serve as a safety cut-off device should the operator place his hands or other body parts beneath the presser foot 162 during operation. Alternatively, the controls may be arranged to automatically start the closing cycle when a can C is placed under the presser foot 162.

As an alternative control, there could be two pushbuttons or switches (not shown) installed on top of the closer 10. In order for the motor to start the user would have to depress both buttons or switches simultaneously. This ensures that the user's hands are not in contact with the can during operation of the closer 10.

The foregoing has described a closer and method for its operation. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A closer for pressing a lid onto a container, comprising:

(a) a presser foot mounted for movement into and out of force applying engagement with the lid;

(b) an actuator moveable between retracted and extended positions;

(c) a force multiplying assembly disposed in operative relationship intermediate the presser foot and the actuator, and adapted to multiply an input force from the actuator to a predetermined maximum lid pressing force at the extended position, wherein the force multiplying assembly includes:

(i) a stationary mounting block;

(ii) a lever arm pivotally connected to the mounting block, the lever arm having a first end connected to the actuator and a second end carrying a cam; and (iii) a cam follower (d) a reciprocating shaft connected to the presser foot and adapted to be driven by the actuator; and (e) an elastic member interconnecting the shaft and the force multiplying assembly such that the lid pressing force is proportional to the displacement of the elastic member; and wherein the cam follower is disposed between the cam and the elastic member.

2. The closer of claim 1 further comprising;

a top plate disposed at an upper end of the shaft; and a retraction roller carried by the second end of the lever arm and positioned to contact the top plate on upward motion of the second end of lever arm.

3. The closer of claim 2 further comprising a pushrod connecting the actuator and the first end of the lever arm.

4. The closer of claim 1 wherein the actuator is a manually-operable handle.

5. The closer of claim 1 further including a housing having:

(a) a base plate;

(b) a pair of spaced-apart side walls extending upwards from the base plate; and (c) a top plate extending between upper ends of the side walls, the top plate carrying the presser foot, actuator and force multiplying assembly;

(d) wherein the housing is adapted to receive a container underneath the presser foot.

6. The closer of claim 5 including a container support disposed between the side walls and moveable between:

(a) a first position in which the container support is clear of the presser foot to allow a container of a first size on the base plate under the presser foot; and (b) a second position in which the container support is disposed under the presser foot so as to support a container of a second size under the presser foot.

7. The closer of claim 6 in which the container support is mounted for pivoting movement between the first and second positions.

8. The closer of claim 6 wherein at least one alignment stop is disposed on the container support so as to align a container in a centered position underneath the presser foot.

9. The closer of claim 5 wherein at least one alignment stop is disposed on the base plate so as to align a container in a centered position underneath the presser foot.

10. The closer of claim 1 wherein the presser foot is sized to engage the lid while maintaining a clearance between the presser foot and a can rim surrounding the lid.

11. The closer of claim 1 wherein the presser foot has a convex curved working face.

12. The closer of claim 1 wherein the presser foot has a stepped working face with an outer portion sized to contact the lid of a first size container, and an inner, downward-protruding portion sized to contact the second size container smaller than the first size container.

13. The closer of claim 1 wherein the presser foot includes an outer ring sized to contact the lid of a first size container, and a coplanar inner ring sized to contact the lid of a second size container smaller than the first size container.

14. In a closer of the type for sealing a cylindrical can which has a raised peripheral can rim disposed at its upper end, and a press-fit lid having a flat center section and an upwardly-extending lid rim, the lid rim sitting below a plane of the can rim in a fully sealed condition, wherein the closer includes an actuator which moves a presser foot into and out of force applying engagement with the lid, the improvement comprising:

the presser foot having a working face which is sized to engage the lid rim while maintaining a clearance between the presser foot and the can rim;

a force multiplying assembly that interconnects the presser foot and the actuator for multiplying an input force from the actuator to a predetermined maximum lid pressing force at the extended position, wherein the force multiplying assembly includes;

(a) a stationary mounting block;

(b) a lever arm pivotally connected to the mounting block, the lever arm having a first end connected to the actuator and a second end carrying a cam;

(c) a cam follower disposed between the cam and an elastic member;

a reciprocating shaft connected to the presser foot and adapted to be driven by the actuator; and wherein the elastic member interconnecting the shaft and the force multiplying assembly such that the lid pressing force is proportional to the displacement of the elastic member.

15. The closer of claim 14 further comprising:

a top plate disposed at an upper end of the shaft; and a retraction roller carried by the second end of the lever arm and positioned to contact the top plate on upward motion of the second end of lever arm.

16. The closer of claim 15 further comprising: a pushrod connecting the actuator and the first end of the lever arm.

* * * * *